US005477770A

United States Patent [19]

Ono et al.

[11] Patent Number: 5,477,770

[45] Date of Patent: Dec. 26, 1995

[54] VALVE CONTROL UNIT FOR HYDRAULIC ACTUATOR

[75] Inventors: Tomoaki Ono; Shoji Tozawa; Satoshi Fujii; Koichi Harada; Makoto Sakai, all of Tokyo, Japan

[73] Assignee: Shin Caterpillar Mitsubishi Ltd., Tokyo, Japan

[21] Appl. No.: 313,838

[22] Filed: Sep. 28, 1994

[30] Foreign Application Priority Data

Sep. 30, 1993 [JP] Japan ..... 5-267876

[51] Int. Cl.[6] ..... F15B 13/044; F15B 11/08

[52] U.S. Cl. ..... 91/459; 91/461

[58] Field of Search ..... 91/461, 459, 361, 91/521, 527

[56] References Cited

U.S. PATENT DOCUMENTS

| | | | |
|---|---|---|---|
| 4,625,622 | 12/1986 | Gunda et al. | 91/361 X |
| 5,110,085 | 5/1992 | Iwasawa | 91/461 X |
| 5,235,809 | 8/1993 | Farrell | 91/461 X |
| 5,333,533 | 8/1994 | Hosseini | 91/361 |
| 5,357,878 | 10/1994 | Hare | 91/361 X |

FOREIGN PATENT DOCUMENTS

| | | |
|---|---|---|
| 0368636A2 | 5/1990 | European Pat. Off. . |
| 0404953A1 | 1/1991 | European Pat. Off. . |

*Primary Examiner*—Edward K. Look
*Assistant Examiner*—Hoang Nguyen
*Attorney, Agent, or Firm*—Oliff & Berridge

[57] ABSTRACT

A valve control unit includes a main hydraulic oil circuit and a pilot oil circuit. The main circuit includes a main pump, a main valve downstream from the main pump, and a hydraulic actuator downstream from the main valve. The pilot oil circuit circulates pressurized pilot oil to control the main valve and includes a pilot oil pump, an automatic control switching valve downstream from the pilot oil pump, a manual limit switching valve downstream from the pilot oil pump, a manual control switching valve downstream from the manual limit switching valve, and a pilot oil chamber downstream from the manual control switching valve. The pilot oil chamber is located near the main valve such that the flow of pressurized pilot oil moves the main valve.

28 Claims, 12 Drawing Sheets

VALVE CONTROL UNIT FOR HYDRAULIC ACTUATOR

FIELD OF THE INVENTION

The present invention relates to a valve control unit for hydraulic actuators used in machinery such as construction equipment.

DESCRIPTION OF THE RELATED ART

Some valve control units for hydraulic actuators are equipped with an automatic control switching valve for automatically controlling a main valve and a manual control switching valve for manually controlling the main valve. Both the automatic control switching valve and the manual control switching valve are connected to a hydraulic pilot oil circuit between a pilot pump and a pilot chamber of the main valve. The pilot oil circuit supplies pressurized pilot oil to the pilot chamber in order to automatically and manually control the main valve that drives the hydraulic actuator. While manually controlling the manual control switching valve in such a valve control unit, however, an operator may not detect that the hydraulic actuator has reached its a predetermined limit state position (i.e., the hydraulic actuator is either fully extended or fully retracted), but because manual control continues, pressurized oil continues to be supplied to the main valve. In view of this problem, a limit state manual switching valve can be provided to switch a pilot hydraulic passage in order to stop the flow of pressurized oil to the main valve when the hydraulic actuator reaches the predetermined limit state.

The hydraulic circuit of a conventional valve control unit, as shown in FIG. 12, includes a main pump 51, a pilot pump 52, a power source (driving mechanism) 53 that drives the main pump 51 and the pilot pump 52, an actuator (hydraulic cylinder) 54, a main valve 55 disposed in a main hydraulic circuit between the main pump 51 and the actuator 54, a stroke sensor 56 for detecting the length that the actuator 54 extends or retracts, a control section 57, an automatic control switching valve 58, 59 that is switched according to the automatic control command of the control section 57, a manual control switching valve 60, an oil reservoir 61, and a manual operation detection sensor 62 for detecting when the manual control switching valve 60 is operating.

During the operation of the conventional valve control unit, a limit state manual switching valve 63, 64 closes a pilot oil passage to stop pressurized oil from being further supplied to the main valve by switching the main valve according to a control command once the actuator 54 is detected to have reached a predetermined limit state. Two limit state manual switching valves are disposed in the pilot oil passage between the manual control switching valve 60 and each pilot chamber 55*a*, 55*b* of the main valve 55. At the point in time shown in FIG. 12, the hydraulic actuator 54 will soon reach the limit state and the pilot oil that has been supplied through the manual control switching valve 60 to the pilot chambers 55*a*, 55*b* will be discharged into the oil reservoir 61.

The conventional valve control unit includes two manual limit switching valves 63, 64, one being disposed in the hydraulic circuit between the manual control switching valve 60 and each pilot chamber 55*a*, 55*b* of the main valve 55. Accordingly, the conventional valve control unit requires one pair of manual limit switching valves for each actuator, which increases component and construction costs and lowers reliability.

SUMMARY OF THE INVENTION

An object of the present invention is to provide a valve control unit for a hydraulic actuator that eliminates at least one of the pair of manual limit switching valves as required in the prior art system. The valve control unit of the present invention includes an automatic control switching valve for automatically controlling a main valve and a manual control switching valve for manually controlling the main valve, each switching valve being disposed in a pilot oil circuit that supplies pressurized pilot oil from a pilot pump to a pilot chamber of the main valve for driving the actuator in order to perform both manual and automatic control. The manual limit switching valve is disposed in the pilot hydraulic passage between the pilot pump and the manual control switching valve to switch that passage, thereby closing it to the flow of pressurized oil from the main valve when the actuator has reached the predetermined limit state.

Furthermore, the valve control unit includes an automatic control switching valve for automatically controlling a main valve and a manual control switching valve for manually controlling the main valve, both of which are disposed in the pilot oil passage.

Moreover, the present invention can be embodied such that each one of a number of manual control switching valves is provided in a single valve assembly, and the single valve assembly includes a number of pump ports connected to the side of the pilot pump and corresponding to each one of the manual control switching valves.

In the present invention, a single manual limit control switching valve corresponds to each actuator for switching the pilot oil passage in order to stop pressurized oil from being further supplied to the main valve when the actuator has reached the predetermined limit state.

BRIEF DESCRIPTION OF THE DRAWING

A complete understanding of the present invention may be obtained by reference to the accompanying drawings, when considered in conjunction with the subsequent detailed description thereof, in which.

DESCRIPTION OF PREFERRED EMBODIMENTS

Figure 1:
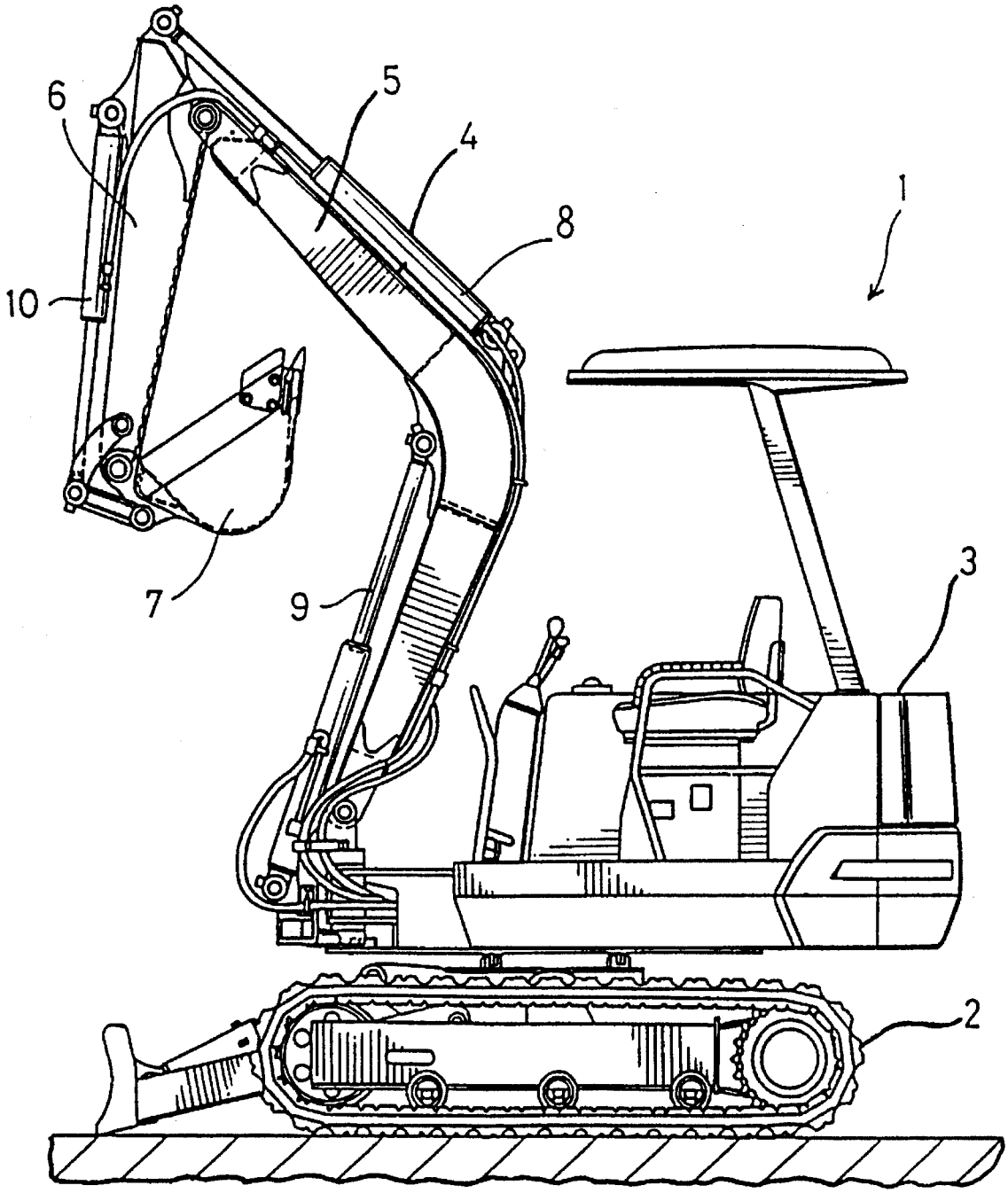
FIG. 1 is a schematic side view of a hydraulic shovel.

Referring to the drawings, and in particular to FIG. 1, reference numeral 1 denotes a conventional hydraulic shovel, having a tracked carriage 2, a rotating section 3 mounted to the tracked carriage 2, and an operating section 4 that is connected to the front of the rotating section 3. The operating section 4 includes a boom 8, an arm 6, and a bucket 7, each of which can be operated by extending or retracting a hydraulic cylinder 11, such as an arm cylinder 8, a boom cylinder 9, and a bucket cylinder 10. The various hydraulic cylinders 11 correspond to the hydraulic actuators of the present invention.

Figure 2:
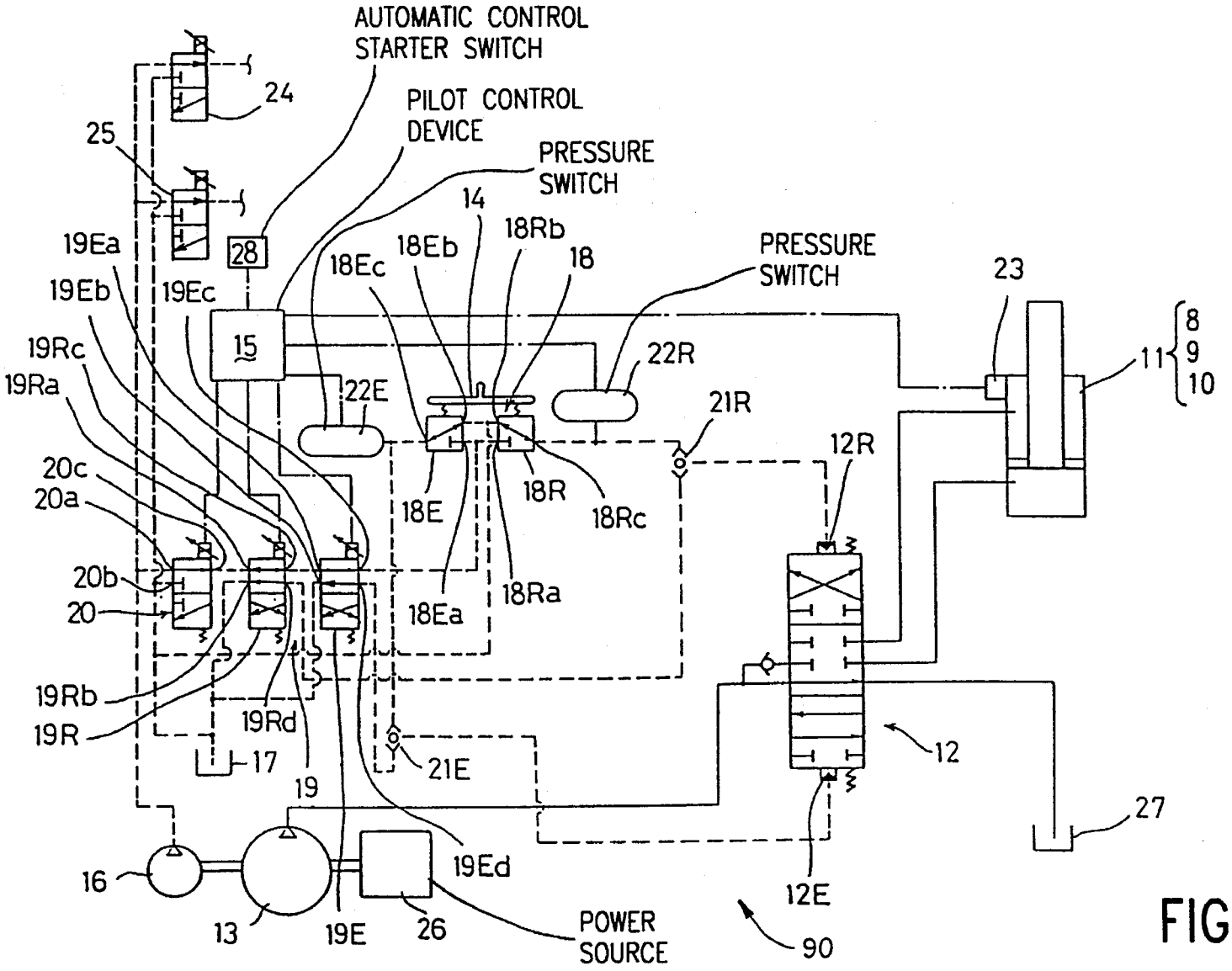
FIG. 2 is a schematic diagram of the hydraulic circuit of a valve control unit in limit state.

In FIG. 2, a valve control unit 90 is shown. The valve control unit 90 includes a main hydraulic circuit that extends from a main pump 13 to an extension side and a retraction side of each hydraulic cylinder 11 and is opened or closed according to a switching operation of a main valve 12. Each main valve 12 is a 6-port 3-position switching valve of the spring-forced neutral return type. The main valve switching operation is carried out with pressurized pilot oil that is fed by manually controlling a manual operating device, such as an operating lever 14, and by automatic control according to a command transmitted from a pilot control device 15 (described below in greater detail). A main pump 13 and a pilot pump 16 are powered by a power source 26. Oil in a main hydraulic circuit is pumped by the main pump 13 to the main valve 12 and then returns to a main reservoir 27.

The feeding of the pressurized pilot oil can be described, for example, with reference to the main valve 12 of the boom cylinder 9. A first switching valve 18, a second switching valve 19, and a third switching valve 20, all of which are proportional control valves, are disposed between each pilot chamber 12E, 12R (of the extension and retraction sides of the main valve 12) and the pilot pump 16 and an oil reservoir 17. The first switching valve 18 (corresponding to a manual control switching valve) comprises a first extension switching valve 18E on the extension side and a first retraction switching valve 18R on the retraction side and operates to selectively switch the first extension switching valve 18E or the first retraction switching valve 18R according to a control input from the manual operating device 14. The second switching valve 19 (corresponding to a automatic control switching valve) and the third switching valve 20 (corresponding to a limit state manual switching valve) are electromagnetic valves of the 2-position switching type that are switched according to a control command from a pilot control device 15 to a solenoid in each valve. The second switching valve 19 comprises a second extension switching valve 19E on the extension side and a second retraction switching valve 19R on the retraction side (when addressing both 19E, 19R, they will be referred to as second switching valve 19).

Beginning at the pilot pump 16, pilot oil flows through the third switching valve 20, a second retraction switching valve 19R of the second switching valve 19, and through a second extension switching valve 19E of the second switching valve 19 to the first switching valve 18. Each port of the switching valves 18, 19, and 20 is connected as shown. Ports 20*a*, 20*b*, and 20*c* of the third switching valve 20 are connected to the pilot pump 16, the oil reservoir 17, and a port 19R*a* of the second retraction switching valve 19R, respectively. Ports 19R*b*, 19R*c*, and 19R*d* of the second retraction switching valve 19R are connected to the oil reservoir 17, a port 19E*a* of the second extension switching valve 19E, and a pilot chamber 12R, respectively. Ports 19E*b* and 19E*d* of the second extension switching valve 19E are connected to the oil reservoir 17 and a pilot chamber 12E, respectively. A port 19E*c* extends to the first switching valve 18 and branches to connect a port 1SE*a* of the first extension switching valve 18E with a port 18R*a* of the first retraction switching valve 18R. Furthermore, ports 18E*b* and 18E*c* of the first extension switching valve 18E are connected to the oil reservoir 17 and the pilot chamber 12E, respectively. The hydraulic passage that leads from the port 18E*c* to the pilot chamber 12E is connected by a shuttle valve 21*e* with the oil passage that leads from the port 19E*d* of the second extension switching valve 19E to the pilot chamber 12E. Ports 18R*b* and 18R*c* of the first retraction switching valve 18R are connected to the oil reservoir 17 and the pilot chamber 12R, respectively. The hydraulic passage that leads from the port 18R*c* to the pilot chamber 12R is connected by a shuttle valve 21R with the oil passage that leads from the port 19R*d* of the second retraction switching valve 19R to the pilot chamber 12R.

A valve passage switching operation of each switching valve 18, 19, and 20 will be now described. The first switching valve 18 functions to selectively switch the first extension switching valve 18E or the first retraction switching valve 18R according to the side toward which the operating lever 14 has been moved. If, for example, the operating lever 14 is moved toward the right (i.e., to the position shown in FIG. 2A or 3), the valve passage that leads from the second extension switching valve 19E to the pilot chamber 12R opens and the valve passage that leads from the pilot chamber 12R to the oil reservoir 17 closes.

Pressure switches 22E and 22R are provided in each hydraulic passage between the first extension switching valve 18E and the shuttle valve 21E, and the first retracting switching valve 18R and the shuttle valve 21R, respectively. The pressure switches 22E and 22R send a detection signal to the pilot control device 15 when the pressure of the pilot oil exceeds a predetermined value. The pilot control device 15 determines if the hydraulic actuator is being manually controlled when the detection signal is received from the pressure switches 22E and 22R. If the hydraulic actuator is being manually controlled, the manual control signals override the automatic control signals.

The second switching valve 19 is switched in accordance with the commands transmitted from the pilot control device 15. When the command from the pilot control device 15 changes from manual control to automatic control, however, only the third switching valve 20 (corresponding to a manual extension or retraction of the boom cylinder 9) is switched.

If the pilot control device 15 transmits a command to the second extension switching valve 19E, it changes from a first position in which a valve passage connecting the second retraction switching valve 19R and the first extension switching valve 18E was open and a valve passage leading from the pilot chamber 12E to the oil reservoir 17 was open to a second position in which a valve passage between the second retraction switching valve 19R and the pilot chamber 12E becomes open and a valve passage connecting the first switching valve 18 and the oil reservoir 17 becomes open. If the pilot control device 15 transmits a command to the second retraction switching valve 19R, it changes from a first position in which a valve passage connecting the third switching valve 20 and the second extension switching valve 19E was open and a valve passage connecting the pilot chamber 12R to the oil reservoir 17 was open to a second position in which a valve passage between the third switching valve 20 and the pilot chamber 12R becomes open and a valve passage connecting the second extension switching valve 19E and the oil reservoir 17 becomes open.

If a limit-stop command (as described in detail below) has been transmitted from the pilot control device 15, the third switching valve 20 changes from a first position in which a valve passage connecting the pilot pump 16 and the second retraction switching valve 19R was open and a valve passage between the second retraction switching valve 19R and the oil reservoir 17 was open to a second position in which a valve passage connecting the pilot pump 16 and the second retraction switching valve 19R becomes open and a valve passage between the second retraction switching valve 19R and oil reservoir 17 becomes open.

A stroke sensor 23 is mounted on the boom cylinder 9 for sending a detection signal to the pilot control device 15. During manual control when a detection signal is transmitted from the pressure switch 22E or 22R, the pilot control device 15 transmits a limit-stop command to the third switching valve 20 when the detected value transmitted from the stroke sensor 23 reaches a predetermined extension-retraction limit value for the boom cylinder 9. This extension-retraction limit value may be varied by the operator. When the limit-stop command is transmitted, the third switching valve 20 is switched from the first position to the second position. The pilot control device 15 transmits a limit stop releasing command to the third switching valve 20, directing it to return from the second position to the first position, when the detection signal has not been transmitted from the pressure switch 22E or 22R.

Although the feeding of pressurized oil to the main valve has been illustrated above with reference to only the boom cylinder 9, the components and their configuration are similar for the arm cylinder 8 and the bucket cylinder 10.

Hydraulic passages which lead from the pilot pump 16 to a third switching valve for an arm cylinder 24 and from the pilot pump 16 to a third switching valve for a bucket cylinder 25, are positioned so as to branch midway along a hydraulic passage between the pilot pump 16 and the third switching valve for the boom cylinder 20, respectively.

Figure 2A:
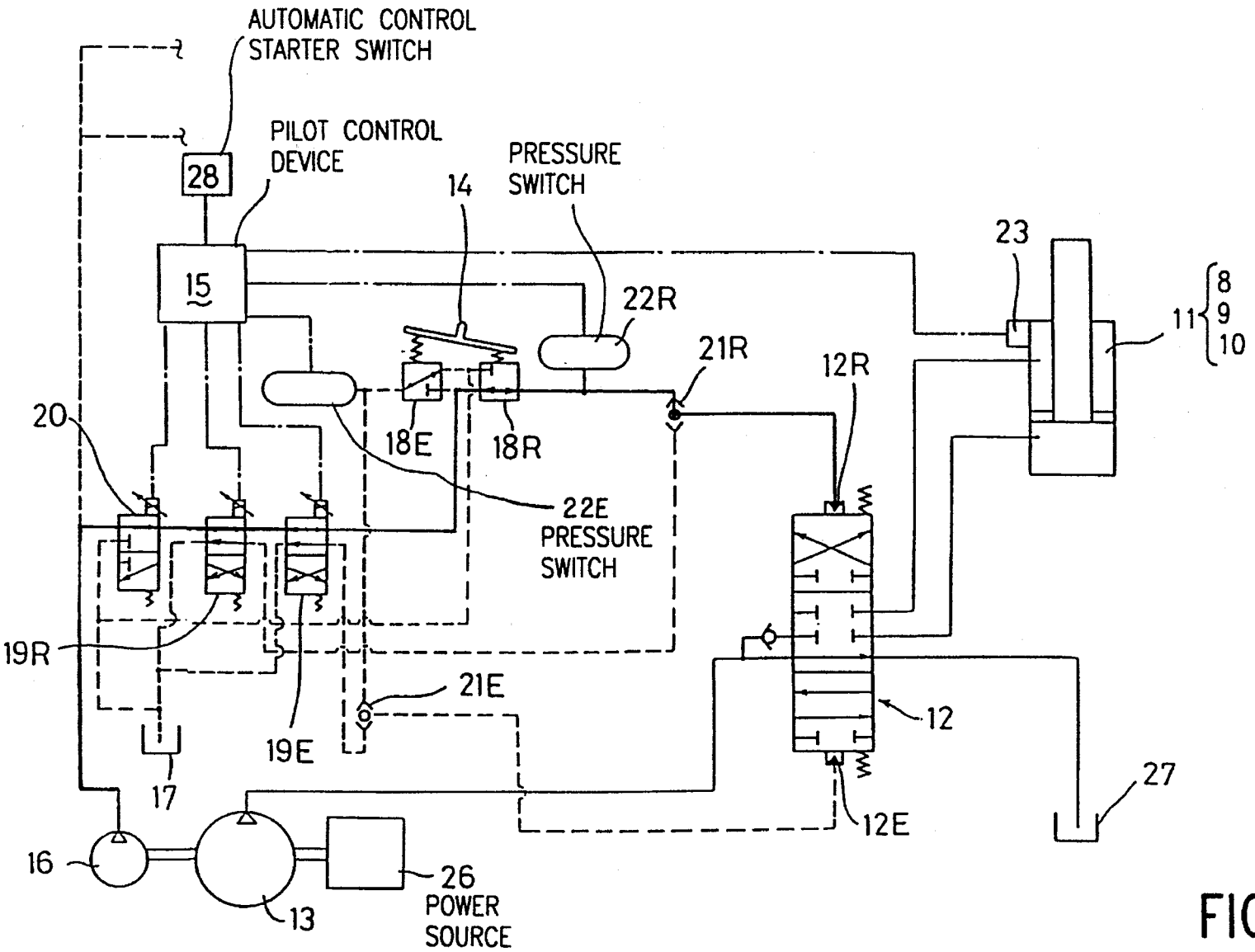
FIG. 2*a* is a schematic diagram of the hydraulic circuit showing the main valve being manually retracted.

With reference to FIGS. 2, 2A, 3 and 4, the control of the boom cylinder 9 can be described. For example, when the operating lever 14 is moved to the retraction side (i.e., to the right as shown in FIG. 2A), the first retraction switching valve 18R is switched and the valve passage between the second retraction switching valve 19R and the pilot chamber 12R opens, thereby allowing pressurized pilot oil to flow from the pilot pump 16 to the pilot chamber 12R through the third switching valve 20, the second switching valve 19, and the first retraction switching valve 18R (i.e., as depicted by the heavy solid line). The main valve 12 is then switched to the retraction side (not shown) and the detection signal from the pressure switch 22R is transmitted to the pilot control device 15, which determines that the boom cylinder is being manually controlled.

Figure 3:
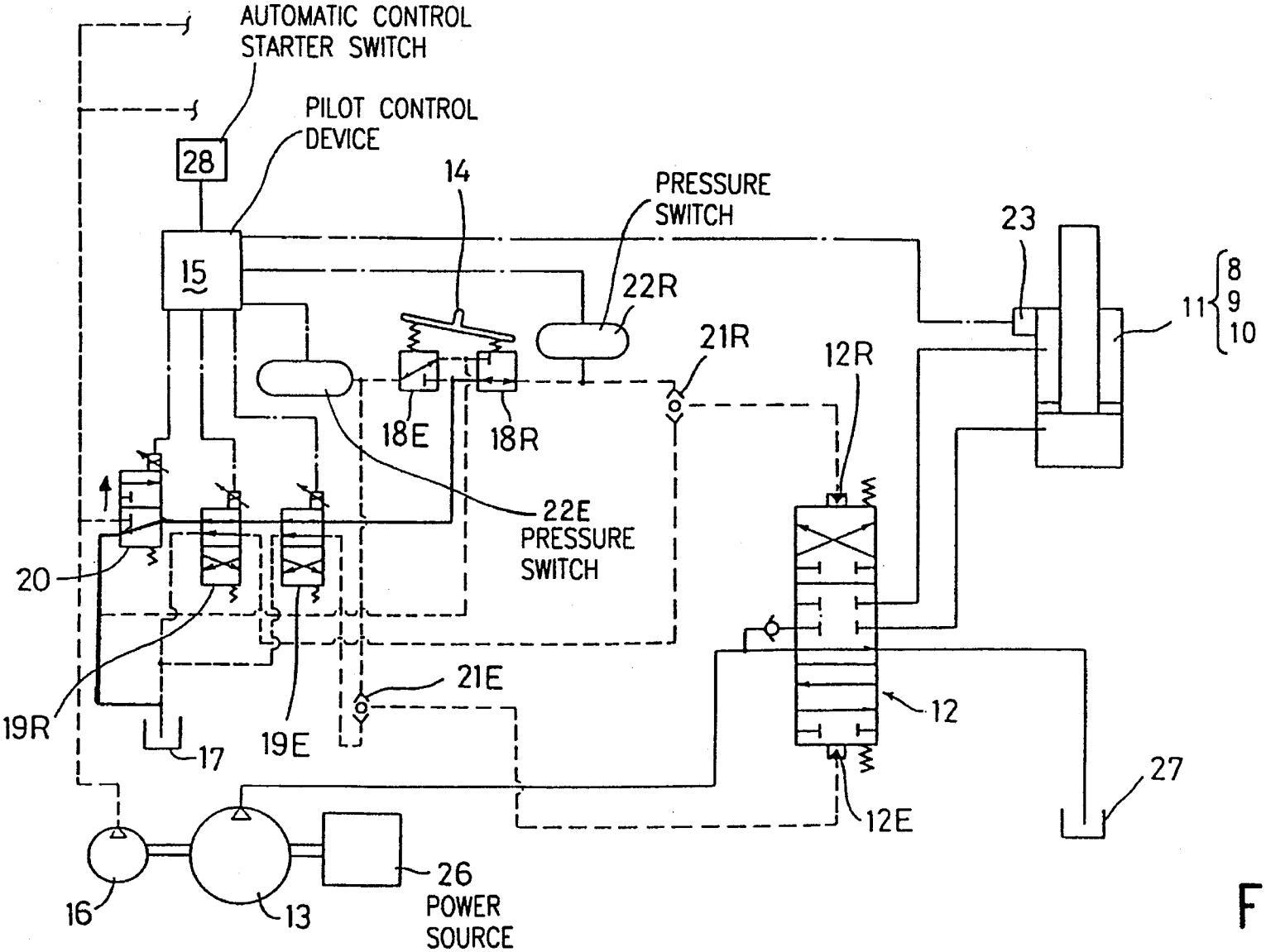
FIG. 3 is a schematic diagram of the hydraulic circuit when a limit stop command is transmitted while the main valve is being manually retracted.

While the boom cylinder 9 is being manually retracted, if the pilot control device 15 determines that a detected value transmitted from the stroke sensor 23 is the predetermined minimum limit value, a limit-stop command is transmitted from the pilot control device 15 to the third switching valve 20. As shown in FIG. 3, the third switching valve 20 then changes from the first position to the second position, thereby closing the hydraulic passage between the pilot pump 16 and the first retraction switching valve 18R and stopping the flow of pressurized pilot oil to the pilot chamber 12R (i.e., as depicted by the heavy solid line). The main valve 12 returns to a neutral position (not shown). If a detection signal is not transmitted from the pressure switch 22R to the pilot control device 15 because the main valve has returned to the neutral position, the pilot control device 15 transmits a limit-stop releasing command to the third switching valve 20. The third switching valve 20 then returns from the second position to the first position.

Figure 4:
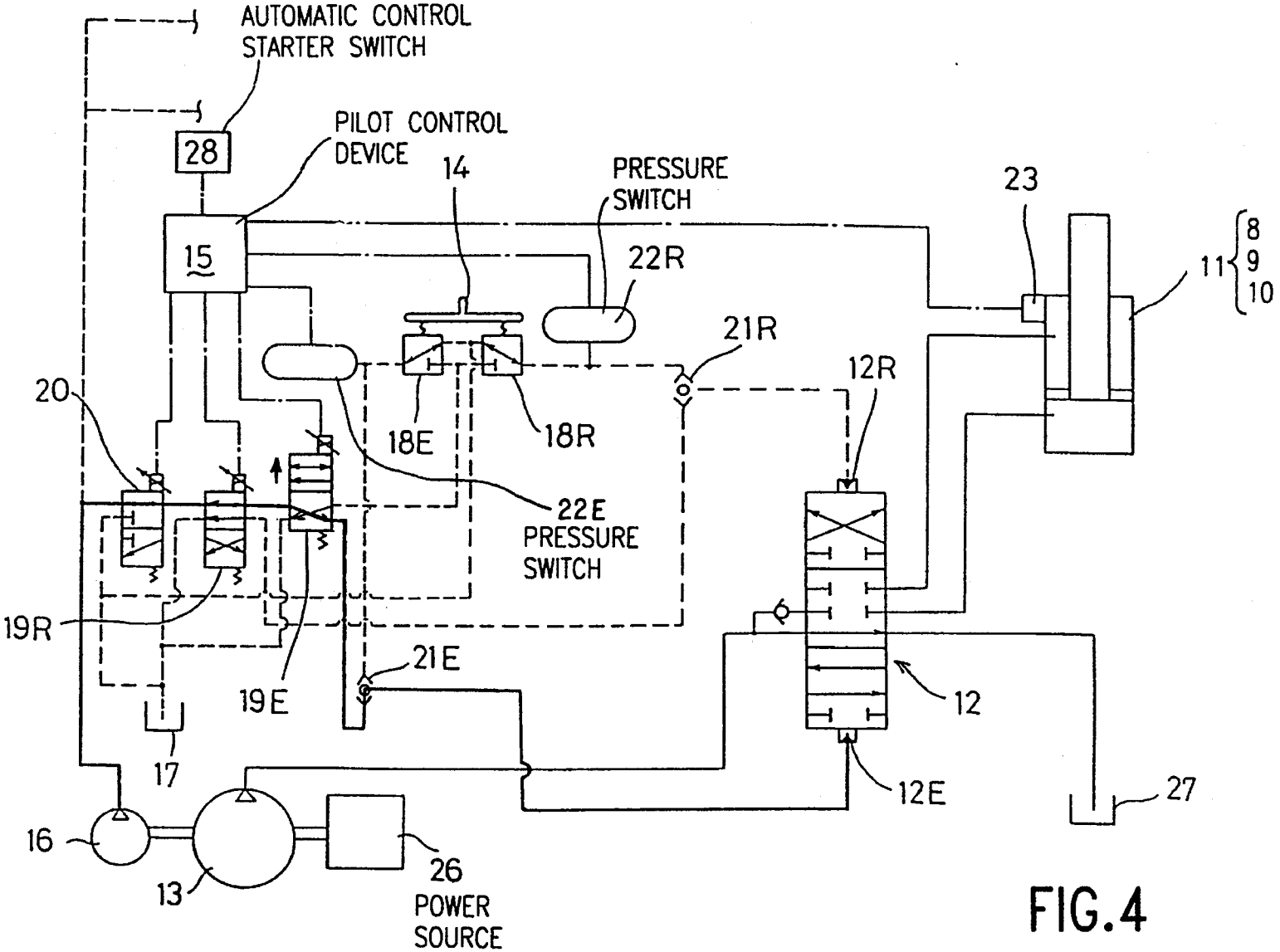
FIG. 4 is a schematic diagram of the hydraulic circuit of a valve control unit in an automatic control state.
Figure 5:
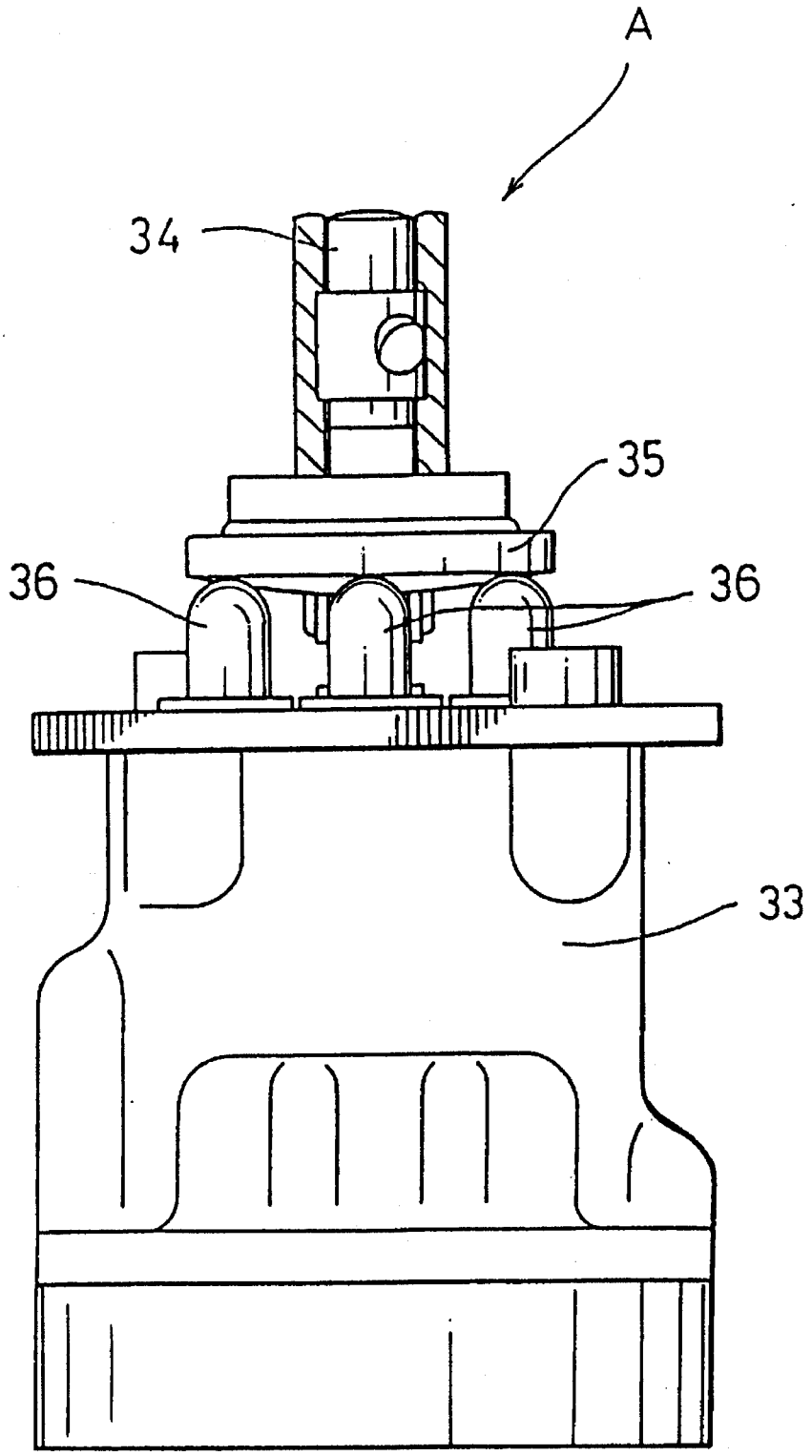
FIG. 5 is a front view of a valve assembly.
Figure 6:
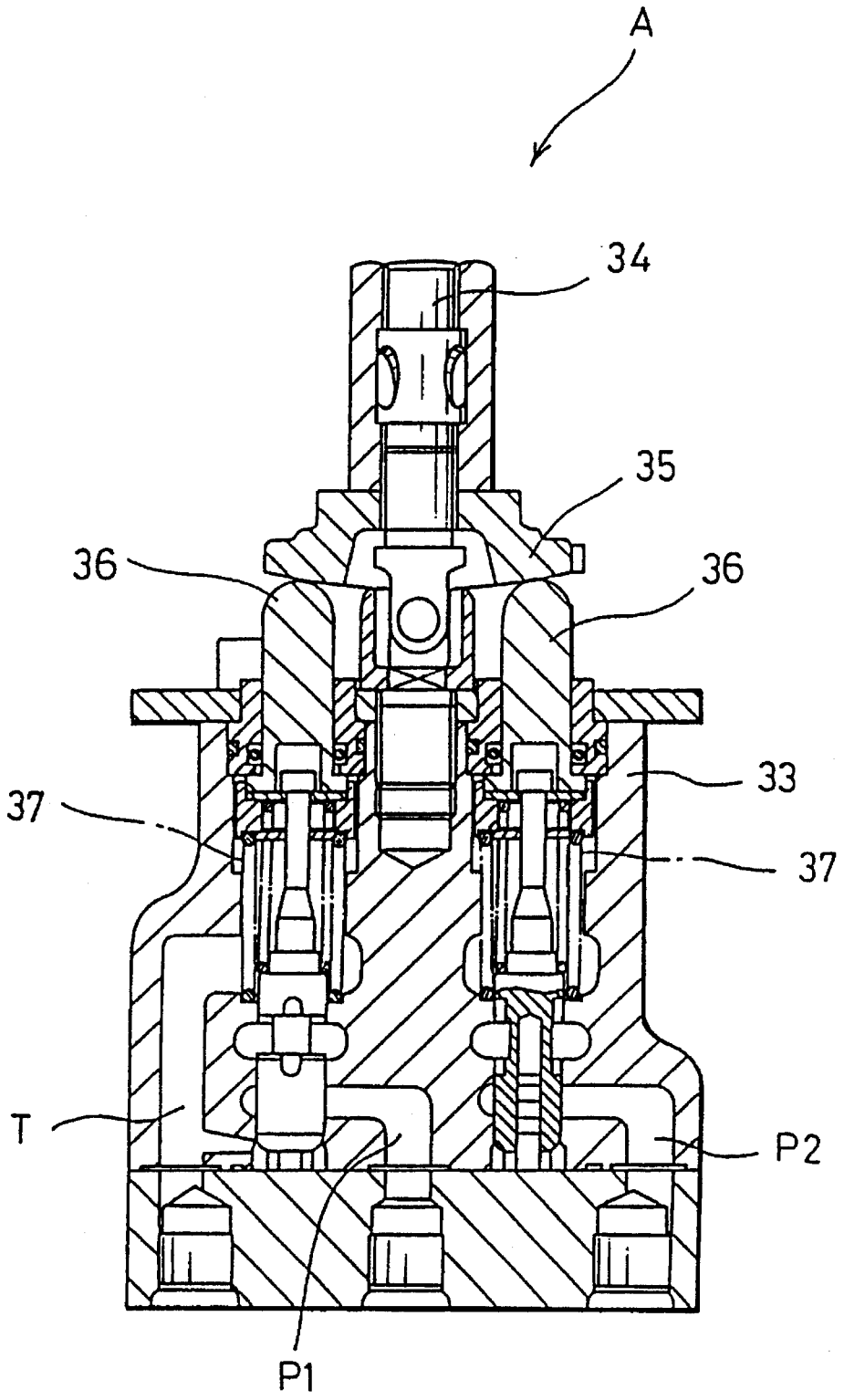
FIG. 6 is a sectional view of a valve assembly.
Figure 7:
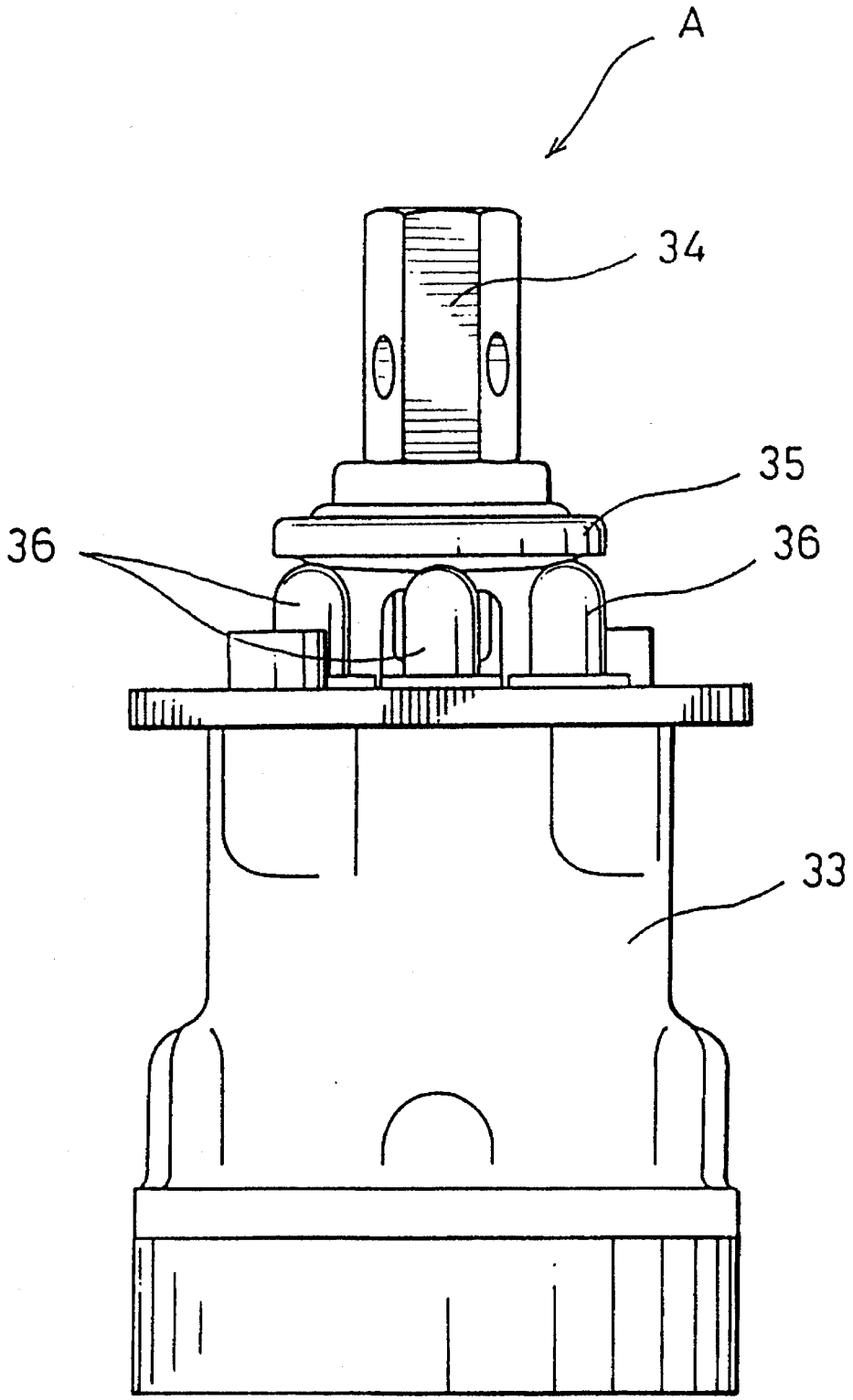
FIG. 7 is a side view of a valve assembly.
Figure 8:
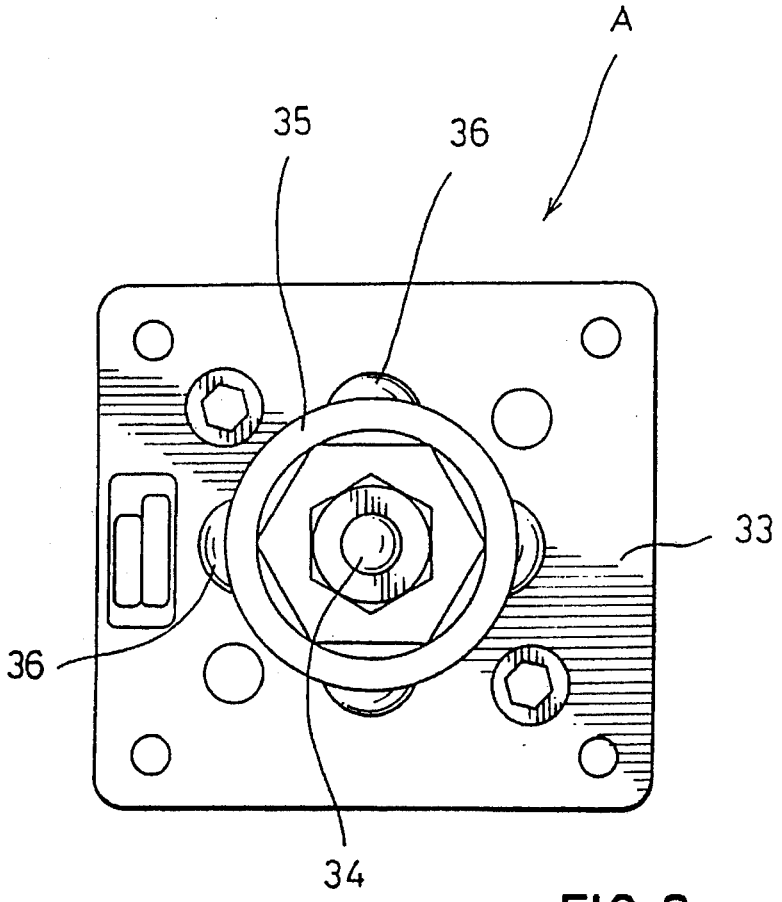
FIG. 8 is a top plan view of a valve assembly.

If the operating lever 14 is not moved, the pilot control device 15 determines that the hydraulic cylinders are in the automatic control state so long as the automatic control starter switch 28 has been turned on. If a command to, e.g., extend the boom 9, is transmitted to the second extension switching valve 19E by automatic control, the second extension switching valve 19E opens the valve passage between the second retraction switching valve 19R and the pilot chamber 12E (FIG. 4). Pressurized pilot oil flows from the pilot pump 16 to the pilot chamber 12E through the third switching valve 20 and the second switching valve 19, (i.e., as depicted by the heavy solid line) and the main valve 12 switches to the extension side (not shown).

Configurations for both instantaneous switching and gradual switching may be used to operate the third switching valve 20. Although instantaneous switching permits the main valve to be stopped instantaneously, gradual switching is used to gradually control the flow at the deceleration starting position slightly before the extension or retraction limit position. In other words, since a certain time period elapses before the main valve 12 returns to the stopping position, the boom cylinder 9 gradually decelerates and then stops.

In the case of gradual switching, detecting the deceleration starting position is accomplished by detecting whether the detected value from the stroke sensor 23 has reached the predetermined value before the extension or retraction limit value. For convenience, the predetermined value can be freely set by the operator. Then deceleration begins at the deceleration starting position to stop the boom cylinder 9 smoothly and without impact at either the extension or retraction limit position.

Moreover, when the detection of the deceleration starting position is made in accordance with the detected value from a sensor such as a stroke sensor which detects the value continuously as it changes, discretionary predetermined detected values distinct from the extension and retraction limit values can be set as a deceleration starting position value. In addition, in the case of a transfer switch which is switched by detecting a certain position, the deceleration starting position detecting switch can be provided for detection of the position, in addition to the extension or retraction limit position detecting switch.

Thus, the embodiment according to the present invention may selectively use automatic control and manual control, and when the hydraulic cylinder 11 reaches the extension or retraction operating limit state in manual control, the third switching valve 20 is automatically switched, and pressurized oil feeding to the hydraulic cylinder 11 is stopped. This prevents a possible malfunction in which pressurized oil would continue to flow after the hydraulic cylinder 11 reached its limit state. In this case, since the third switching valve 20 (which is switched when the hydraulic cylinder is in the operating limit state) is disposed in a pilot oil passage that connects the pilot oil pump 16 and the first automatic control switching valve 18, one of the third switching valves 20E, 20R can be used to control one hydraulic cylinder 11. Consequently, it becomes unnecessary to provide a pair of manual limit switching valves for each of the hydraulic cylinders 11, in the same way that manual limit switching valves are disposed between each manual control switching valve and each pilot chamber of the main valve, respectively. Accordingly, the number of manual limit switching valves can be reduced by half, and constructing of the valve control unit becomes simpler and cheaper.

In another embodiment of the present invention, each first switching valve of a number of hydraulic cylinders is incorporated into a single valve assembly. FIGS. 5–10 depict a valve assembly A into which the first switching valves 18E, 18R of the boom cylinder 9 and the first switching valves 30E, 3OR of the bucket cylinder are incorporated.

Figure 9:
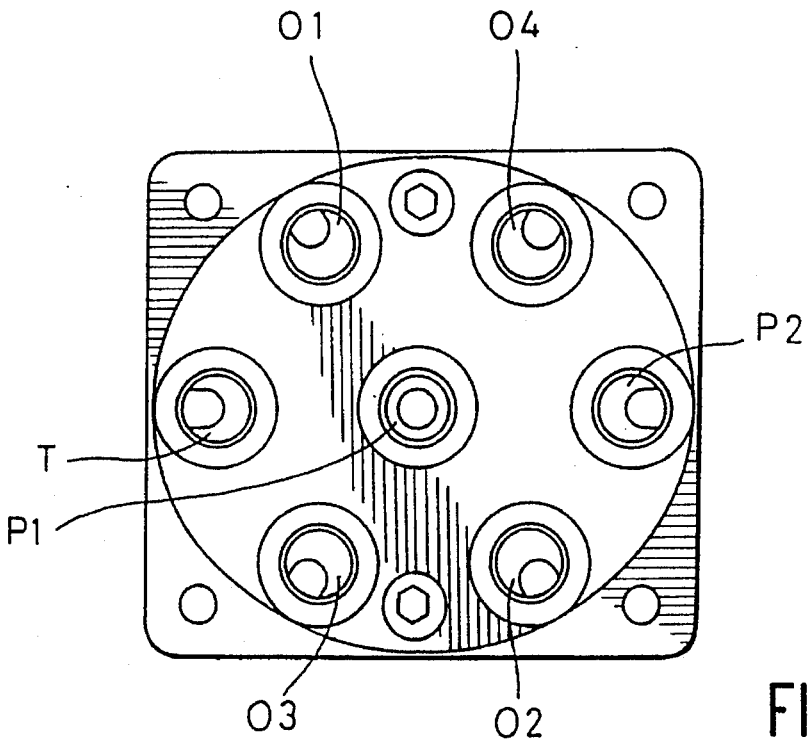
FIG. 9 is a bottom plan view of a valve assembly.
Figure 10:
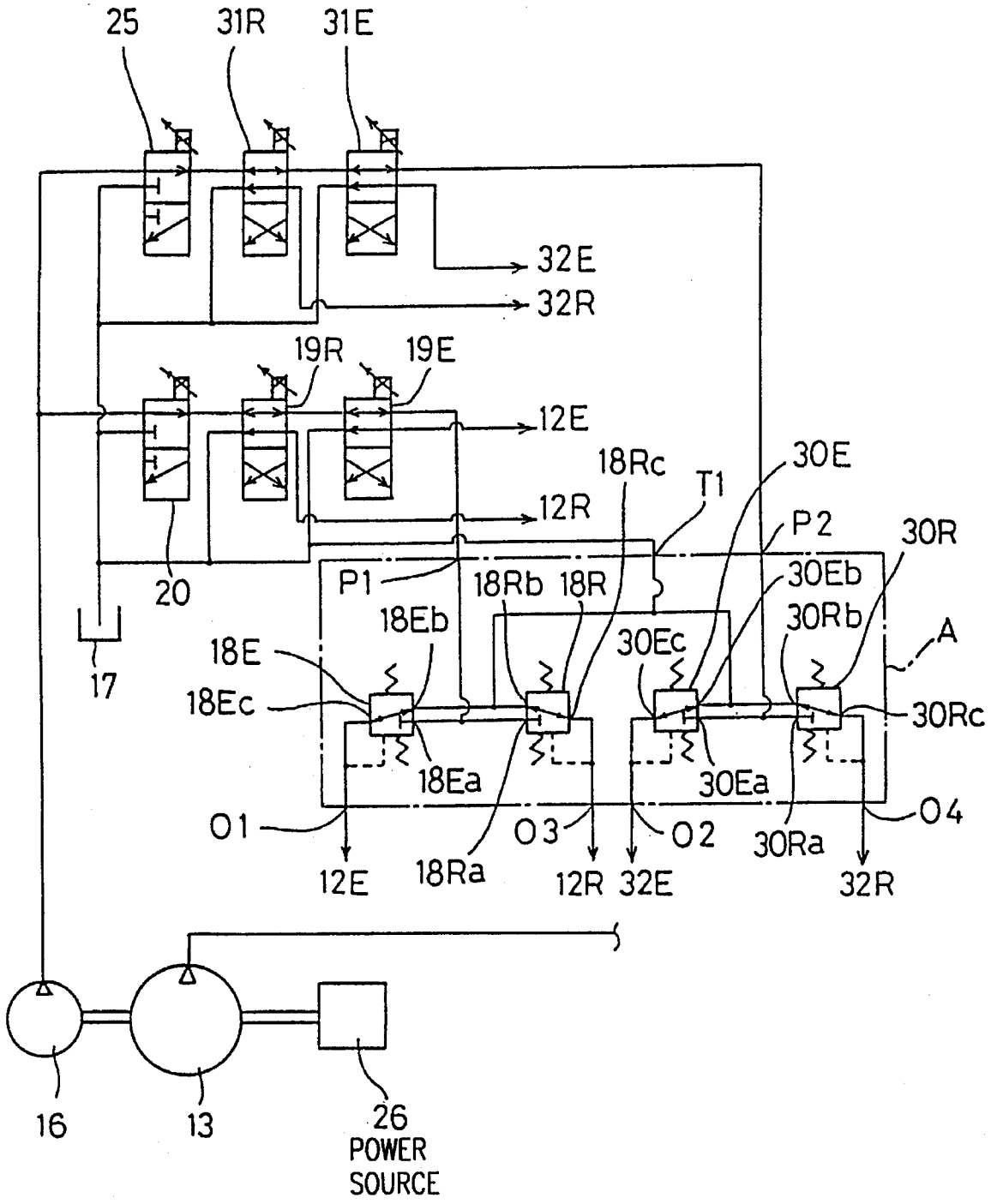
FIG. 10 is a schematic diagram of a circuit of a valve assembly.

As shown in FIG. 9, the valve assembly A includes two pump ports P1, P2, a tank port T, and four output ports 01, 02, 03, and 04. As shown in FIG. 10, one end of the pump port P1 is connected to a hydraulic passage leading to the second extension switching valve 19E of the boom cylinder (this hydraulic passage further leads to the pilot pump 16 through the second retraction switching valve 19R and the third switching valve 20). The other end of the pump port P1 branches and connects to each port 18E*a*, 18R*a* of the first switching valve of the boom cylinder. One end of the pump port P2 is connected to a hydraulic passage leading to the second extension switching valve 31E of the bucket cylinder (this hydraulic passage further leads to the pilot pump 16 through the second retraction switching valve 31R and the third switching valve 25). The other end of pump port P2 branches and connects to each port 3OE*a*, 3OR*a* of the first switching valves 30E, 3OR of the bucket cylinder. One end of the tank port T is connected to a hydraulic passage leading to the oil reservoir 17. The other end of tank port T branches into a total of four passages, each of which connect to a port 18E*b*, 18R*b*, 3OE*b*, and 3OR*b*. Each end of the output ports 01, 03 is connected by a hydraulic passage to the pilot chamber 12E, 12R, respectively, of the main valve for the boom cylinder and the pilot chamber 32E, 32R, respectively, of the main valve for the bucket cylinder. Each other end of each output port 01, 02, 03, 04 is connected to each port 18E*c*, 18R*c*, 3OE*c*, and 3OR*c*, respectively, of the first switching valves 18E, 18R, 30E, and 3OR.

As shown in FIGS. 5–8, the lower portion of the operating lever 34 is supported on the top of a case 33 of the valve assembly A such that the operating lever 34 can be freely moved in the forward/backward and right/left directions. An operating plate 35 is supported beneath the operating lever 34 by the upper ends of four push rods 36. The four push rods operate to switch the first switching valve 18 by pushing up against the lower surface of the operating plate 35 under the action of springs (not shown). When moving the operating lever 34 forward/backward and right/left, the corresponding one of the four push rods 36 moves downward such that the corresponding first switching valve 18, 30 for switching the valve passages connecting the tank ports P1, P2 and the output ports 01, 02, 03, and 04 is opened and the valve passages connecting the output ports 01, 02, 03, and 04 and the oil reservoir 17 are closed.

As described above, any of the first switching valves 18E, 18R of the boom cylinder 9 and the first switching valves 30E, 3OR of the bucket cylinder 10, may be switched by moving the single operating lever 34. Moreover, since the pump ports P1 and P2 are connected to the pilot pump 16 as provided in this embodiment, it is possible to dispose each of the third switching valves 20 and 25 which block the pilot oil feeding in the cylinder extension-retraction limit state, within a branch of the pilot oil circuit between said pilot oil pump and a corresponding one of the manual control switching valves, and thereby the present invention can be easily embodied.

Figure 11:
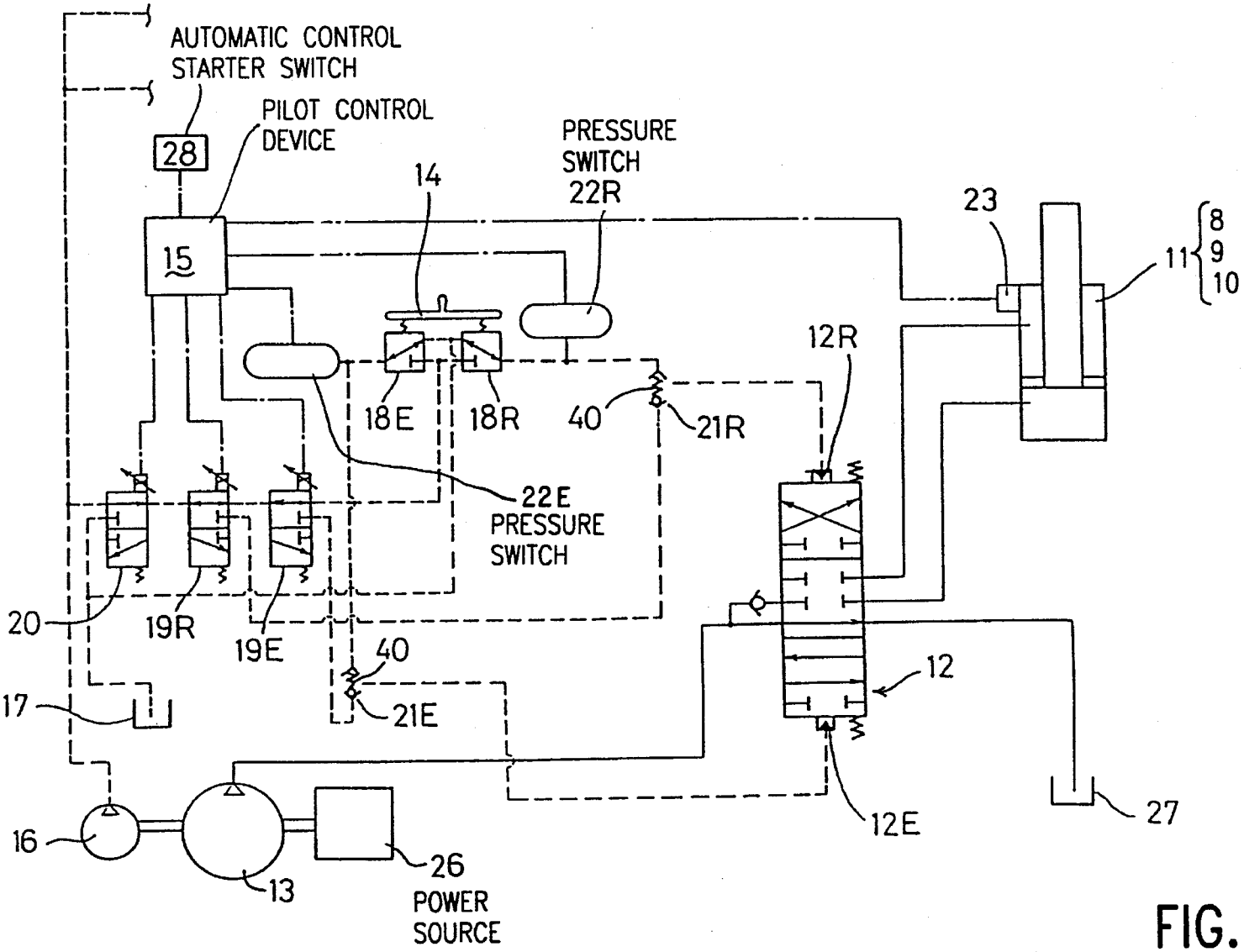
FIG. 11 is a schematic diagram of the hydraulic circuit of a valve control showing an alternative embodiment of the shuttle valves.
Figure 12:
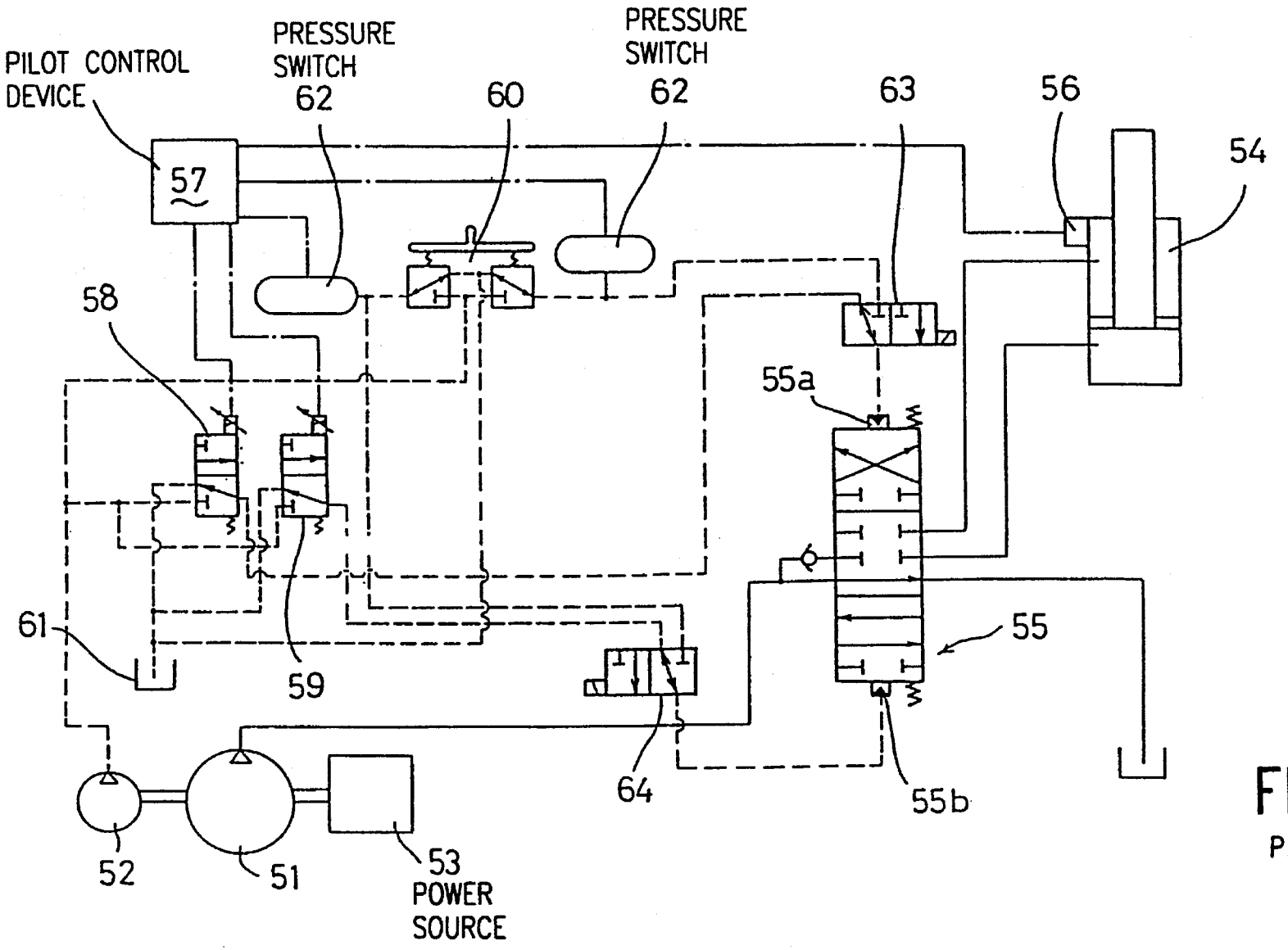
FIG. 12 PRIOR ART
FIG. 12 is a schematic diagram of the hydraulic circuit of a valve control unit showing the prior art.

An alternative embodiment is shown in FIG. 11. The shuttle valves 21E, 21R of the present invention are always open by means of a hydraulic passage between the first switching valve 18 and the pilot chambers 12E, 12R. Alternatively, the shuttle valves may be configured such that they are normally closed under the force of a resilient element 40 (e.g., a spring). In this case, the hydraulic passages between the second switching valve 19 and the pilot chambers 12E, 12R open only when pressurized pilot oil flows from the second switching valves 19E, 19R to the pilot chambers 12E, 12R.

As explained above, the pressure switches 22E, 22R detect whether the system is being operated manually. Alternatively, manual operation can be detected, e.g., by a limit switch of the contact type. In this case, however, the switching operation of the third switching valve 20 is possibly continued while the manual operating device 14 is continually moved even once the actuator has reached the extension or retraction limit, causing a malfunction to result. Such a malfunction may be prevented by adjusting the control of the third switching valve 20. The third switching valve 20 can be controlled such that it does not return to the first position when the extension or retraction limit is detected. The third switching valve 20 is switched from the first position to the second position, and its operation is detected with the limit switch of the limit side (i.e., a limit switch disposed in the place of the pressure switch 22R if, e.g., the actuator is being retracted). The third switching valve 20 is controlled such that it automatically returns to the first position when the operation has been detected with the limit switch of the limit side, otherwise the operation is detected with the limit switch of the non-limit side or an automatic switch operates.

As described above, the valve control unit is designed such that the extent to which the first switching valve 18 can be opened is directly adjustable according to how the operating lever 14 is, e.g., moved with respect to its normal position. This adjustability may also be obtained, e.g., by using an electric joy stick as the manual operating lever 14. When using the electric joy stick, an operating characteristic of the electric joy stick is detected, e.g., with a potentiometer, and the pilot control device 15 receiving the detection signal transmits an operating command to the first switching valve 18 so as to adjust the extent to which it opens. After the third switching valve 20 has been switched to the second position, it can be automatically returned to the second position by controlling it in the same manner as described above in connection with the pressure switch.

Furthermore, the flow of pressurized pilot oil can be blocked not only when the hydraulic actuator reaches the extension or retraction limit, but also when an abnormal load is applied to the hydraulic cylinder, e.g., while it is shifting to the operating limit or when any obstruction is detected. In this case, the invention is preferably embodied so as to include obstruction detection means or an equivalent device (not shown) disposed in proximity to the hydraulic actuator. The obstruction detection means transmits a detection signal to the pilot control device when an obstruction is encountered. In addition, the means for detecting the extension or retraction limit of the hydraulic actuators is not limited to the stroke sensor, since any sensor, e.g., an angle sensor, may be used.

According to the valve control unit of the present invention, which selectively operates according to automatic control or manual control, when a hydraulic actuator reaches the predetermined limit state under manual control, a manual limit state switching valve is switched and further pressurized oil feeding to the main valve is stopped. Accordingly, the present invention prevents a possible malfunction that is characteristic of the prior art valve control units from occurring. In a prior art valve control unit under manual control, pressurized oil continues to flow to the actuator even once it has reached the predetermined extension or retraction limit. Consequently, preventing this malfunction requires providing two manual limit switching valves for each actuator in the prior art valve control unit. In the case of the present invention, however, since the manual limit switching valve is disposed in a pilot hydraulic passage between a pilot pump and the manual switching valve, only a single manual limit switching valve needs to be used for each actuator. Therefore, the number of switching valves can be reduced by half and, the construction of a valve control unit may be simplified.

When more than one manual control switching valve is required because of the corresponding more than one hydraulic actuators, each pump port corresponding to each actuator may be incorporated into a single valve assembly together with the manual control switching valves. In this manner, the manual limit switching valves can be easily positioned and the piping of the pilot hydraulic passage is conveniently simplified.

Since other modifications and changes varied to fit particular operating requirements will be apparent to those skilled in the art, the invention is not considered to be limited to the examples chosen for the purpose of disclosure, and thus, the invention covers all changes and modifications that do not constitute a departure from its true spirit and scope.

What is claimed is:

1. A valve control unit, comprising:

a main hydraulic oil circuit having a main pump, a main valve disposed downstream from said main pump, and a hydraulic actuator disposed downstream from said main valve; and a pilot oil circuit for circulating pressurized pilot oil to control said main valve, said pilot oil circuit having a pilot oil pump, a manual limit switching valve disposed downstream from said pilot oil pump, an automatic control switching valve and a manual control switching valve disposed downstream from said manual limit switching valve, and a pilot oil chamber disposed downstream from said automatic control switching valve and said manual control switching valve such that the flow of said pressurized pilot oil from one of said automatic control switching valve and said manual control switching valve moves said main valve.

2. The valve control unit of claim 1, wherein said pilot oil circuit comprises an automatic control circuit and a manual control circuit, said automatic control circuit comprising said pilot oil pump, said manual limit switching valve disposed downstream from said pilot pump, said automatic control switching valve disposed downstream from said manual limit switching valve, and said pilot oil chamber.

3. The valve control unit of claim 2, wherein said automatic control circuit further comprises an automatic control extension circuit and an automatic control retraction circuit, said automatic control extension circuit comprising said pilot oil pump, said manual limit switching valve disposed downstream from said pilot pump, said automatic control switching valve disposed downstream from said manual limit switching valve, and said pilot oil chamber, wherein said pilot chamber is disposed on an extension side of said main valve.

4. The valve control unit of claim 2, wherein said automatic control circuit further comprises an automatic control extension circuit and an automatic control retraction circuit, said automatic control retraction circuit comprising said pilot oil pump, said manual limit switching valve disposed downstream from said pilot pump, said automatic control switching valve disposed downstream from said manual limit switching valve, and said pilot oil chamber, wherein said pilot oil chamber is disposed on a retraction side of said main valve.

5. The valve control unit of claim 1, wherein said pilot oil circuit comprises an automatic control circuit and a manual control circuit, said manual control circuit comprising said pilot oil pump, said manual limit switching valve disposed downstream from said pilot pump, said automatic control switching valve disposed downstream from said manual limit switching valve, said manual control switching valve disposed downstream from said manual limit switching valve, and said pilot oil chamber.

6. The valve control unit of claim 5, wherein said manual control switching valve further comprises a manual control extension switching valve and a manual control retraction switching valve.

7. The valve control unit of claim 6, wherein said manual control circuit further comprises a manual control extension circuit and a manual control retraction circuit, said manual control extension circuit comprising said pilot oil pump, said manual limit switching valve disposed downstream from said pilot pump, said automatic control switching valve disposed downstream from said manual limit switching valve, said manual control extension switching valve disposed downstream from said manual limit switching valve, and said pilot oil chamber, wherein said pilot oil chamber is disposed on an extension side of said main valve.

8. The valve control unit of claim 5, wherein said manual control circuit further comprises a manual control extension circuit and a manual control retraction circuit, said manual control retraction circuit comprising said pilot oil pump, said manual limit switching valve disposed downstream from said pilot pump, said automatic control switching valve disposed downstream from said manual limit switching valve, said manual control retraction switching valve disposed downstream from said manual limit switching valve, and said pilot oil chamber, wherein said pilot oil chamber is disposed on a retraction side of said main valve.

9. The valve control unit of claim 1, wherein said pilot oil circuit further comprises another pilot oil chamber and two junctures disposed downstream from both said automatic control switching valve and said manual control switching valve, said two junctures allowing said pressurized pilot oil to flow into said pilot oil chamber and said another pilot oil chamber, wherein said pilot oil chamber and said another pilot oil chamber are disposed adjacent said main valve.

10. The valve control unit of claim 9, wherein one of two shuttle valves is disposed at each of said two junctures, each of said two shuttle valves being switchable to allow higher pressure pilot oil to flow from said automatic control switching valve and said manual control switching valve into said pilot oil chambers disposed adjacent said main valve.

11. The valve control unit of claim 10, wherein said shuttle valves further comprise resilient elements so as to open said shuttle valves to allow a return flow of pilot oil from said pilot chambers into said manual control switching valve.

12. The valve control unit of claim 10, further comprising a control signal circuit, said control signal circuit having two manual operation sensors for detecting that said manual control switching valve has been switched, a controller connected to said manual operation sensors, a detector for detecting that said actuator has reached an operational limit, an automatic control switching means for switching said automatic control switching valve, and a manual limit switching means for switching said manual limit switching valve, wherein each of said two manual operation sensors includes a pressure activated switching means disposed downstream from said manual control switching valve and upstream from said two junctures.

13. The valve control unit of claim 12, wherein said pressure activated switching means are one of pressure switches and pressure sensors.

14. The valve control unit of claim 1 further comprising a control signal circuit, said control signal circuit having two manual operation sensors for detecting that said manual control switching valve has been switched, a controller connected to said manual operation sensors, a detector for detecting that said actuator has reached the operational limit, an automatic control switching means for switching said automatic control switching valve, and a manual limit switching means for switching said manual limit switching valve.

15. The valve control unit of claim 14, wherein said pilot oil circuit further comprises two shuttle valves and another pilot oil chamber, each of said shuttle valves being disposed at one of two junctures downstream from both said automatic control switching valve and said manual control switching valve, said two shuttle valves allowing higher pressure pilot oil to flow from said automatic control switching valve and said manual control switching valve into said pilot oil chamber and said another pilot oil chamber, wherein said pilot oil chamber add said another pilot oil chamber are disposed adjacent said main valve, and wherein said two manual operation sensors comprise two pressure activated switching means disposed downstream from said manual control switching valve and upstream from said two junctures.

16. The valve control unit of claim 15, wherein said pressure activated switching means are pressure switches.

17. The valve control unit of claim 14, wherein said manual operation sensors are contact-type limit switches that detect whether a manual operating lever for switching said manual control switching valve has been actuated.

18. The valve control unit of claim 14, wherein each of said automatic control switching means for switching said automatic control switching valve and said manual limit switching means for switching said manual limit switching valve is a solenoid provided in each said switching valve.

19. The valve control unit of claim 14, wherein said manual limit switching valve comprises a proportional control valve and said detector transmits a signal to said controller when said actuator reaches a predetermined deceleration starting position before reaching one of an extension limit and a retraction limit, said controller receiving said signal and instructing said manual limit switching valve to switch gradually from a first position toward a second position, said manual limit switching valve having received said instructions being controlled so as to gradually stop the flow of pilot oil from said pilot pump to said main valve and stopping the flow of hydraulic oil from said main valve to said actuator.

20. The valve control unit of claim 14, wherein said detector transmits a signal to said controller when the motion of said actuator is impeded, said controller receiving said signal and instructing said manual limit switching valve to switch from a first position to a second position, said manual limit switching valve in said second position stopping the flow of pilot oil from said pilot pump to said main valve and stopping the flow of hydraulic oil from said main valve to said actuator.

21. The valve control unit of claim 14, wherein said detector comprises a stroke sensor.

22. The valve control unit of claim 14, wherein said detector comprises an angle sensor.

23. The valve control unit of claim 1, wherein said main hydraulic circuit comprises at least two hydraulic actuators and said pilot oil circuit comprises at least two manual limit switching valves, wherein each one of said at least two manual limit switching valves corresponds to one of said at least two hydraulic actuators.

24. The valve control unit of claim 23 further comprising at least two manual control switching valves, each one of said at least two manual control switching valves controlling one of said at least two hydraulic actuators, wherein said at least two manual control switching valves are disposed within a single valve assembly.

25. The valve control unit of claim 23, wherein said single valve assembly includes at least two pump ports, each one of said at least two pump ports corresponding to one of said at least two manual control switching valves.

26. The valve control unit of claim 23, wherein each one of said at least two manual control switching valves is disposed at a corresponding one of at least two branch positions, each one of said at least two branch positions being disposed within said pilot oil circuit between said pilot oil pump and a corresponding one of said at least two manual control switching valves.

27. The valve control unit of claim 23, wherein each of said at least two manual control valves can be actuated by moving a manual operating lever, said manual operating lever being attached to said single valve assembly.

28. A valve control unit for a hydraulic actuator, comprising:

an automatic control switching valve for automatically controlling a main valve; and a manual control switching valve for manually controlling said main valve, said automatic control switching valve and said manual control switching valve being disposed in a pilot hydraulic passage between a pilot pump and a pilot chamber of said main valve for driving said hydraulic actuator in order to perform automatic and manual control, wherein a manual limit switching valve is positioned in said pilot hydraulic passage to stop said pressurized pilot oil from being further supplied to said main valve when said hydraulic actuator reaches a predetermined limit state, said manual limit switching valve being disposed in said pilot hydraulic passage between said pilot pump and said manual control switching valve.

* * * * *